United States Patent [19]

Weaver

[11] 4,450,774

[45] May 29, 1984

[54] DRAFTING AND DRAWING TABLE

[76] Inventor: Johnny L. Weaver, 13555 McCall Ct., NE., Albuquerque, N. Mex. 87123

[21] Appl. No.: 380,465

[22] Filed: May 20, 1982

[51] Int. Cl.[3] ..... A47B 11/00

[52] U.S. Cl. ..... 108/23; 108/104; 108/142

[58] Field of Search ..... 108/23, 104, 142; 248/425; 33/1 R

[56] References Cited

U.S. PATENT DOCUMENTS

| | | | |
|---|---|---|---|
| 324,855 | 8/1885 | Leonard | 108/104 |
| 517,976 | 4/1894 | Hennessy | 108/142 |
| 1,344,900 | 6/1920 | Juresisin | 108/142 |
| 2,215,462 | 9/1940 | Davidson, Jr. et al. | 108/23 |
| 2,495,250 | 1/1950 | Gilly | 108/104 |
| 2,510,363 | 6/1950 | Anderson | 33/1 R |
| 2,855,721 | 10/1958 | Shelly | 108/104 |
| 3,032,917 | 5/1962 | Shine | 108/23 |
| 3,311,070 | 3/1967 | Burzee et al. | 108/23 |
| 3,456,352 | 7/1969 | Bowen | 108/23 |

FOREIGN PATENT DOCUMENTS

| | | | |
|---|---|---|---|
| 34992 | 8/1925 | Denmark | 108/104 |

*Primary Examiner*—William E. Lyddane
*Assistant Examiner*—Mark Binder
*Attorney, Agent, or Firm*—Harvey B. Jacobson; Clarence A. O'Brien

[57] ABSTRACT

A circularly configured rotatable element rotationally mounted for use in a drafting, drawing, tracing or light tabletops of generally rectangular or square configuration, a concave-convex annular interface disposed between the circular element and the adjacent portion of the tabletop and a series of 360° sockets or apertures arranged along the interface for receiving a locking spring pin element therein. Also, indicia displaying 360° markings may be disposed about peripheral portions of the circular element. A swivel assembly such as used in a lazy susan is used to support the rotatable element. In one embodiment, the circular element is constructed of transparent, translucent or similar material with a set of at least a pair of fluorescent lights mounted thereunder. In another embodiment, the rotatable element is in the form of an opaque, light impervious circular element.

8 Claims, 8 Drawing Figures

DRAFTING AND DRAWING TABLE

BACKGROUND OF THE INVENTION

1. Field of the Invention

The present invention relates to drafting, drawing, tracing tables and the like having a rotatable circular element or disc marked with at least four divisions of 90° indicia, or with a display of 360° markings of 1° each about the edge of the circular element. The circular element can be rotated either clockwise or counterclockwise to move the area being worked on in conjunction with a stable working surface of a tabletop. The tabletop cooperates with a retractable slidable locking pin which allows the user to displace the circular element to a new position and then allow the slidable locking pin to again engage with and lock the circular element in relation to the tabletop.

2. Description of the Prior Art

Various drafting and drawing tables are known in the following art in U.S. Pat. Nos.:

324,855 — C. N. Leonard
449,049 — J. B. McElroy
1,008,934 — D. H. White
3,311,070 — V. N. Barzee et al.
3,456,352 — C. E. Bowen The patent to Barzee et al discloses a circular drafting, drawing, tracing and lighted table. The patent to McElroy discloses a drawing board having a clamp screw attachment to facilitate adjustments thereto. The patent to Leonard discloses a circular drawing board and clamping members operated by bellcrank levers. The other patents disclose drafting instruments, and none of the patents provided discloses all of the specific details of the present invention in such a way as to bear upon the patent ability of any claim of the present invention.

SUMMARY OF THE INVENTION

An object and advantage of the present invention is to provide a circular element cooperating with a tabletop so that rotational movement of the circular element is provided with the diameter of the circular element being such that it can accommodate any size paper. Also, the circular element is marked in degrees of, for example, 1° throughout the 360° periphery of the circular element with a lazy susan swivel supporting the circular element. The circular element and tabletop opening include a concave-convex interface between the circular element and the tabletop to maintain a coplanar relation so that use of a T-square, parallel bars or other drafting equipment can be accommodated. In a tracing and light table, the drafting and drawing top assembly can be the circular element constructed of transparent or translucent plastic, tempered glass or other materials for tracing and similar purposes utilizing a light in the form of fluorescent tubes under the transparent element. A lazy susan swivel supports the transparent plate from a base struture within the tabletop. In a drafting and drawing table, the circular element is opaque and the lights are omitted.

Another object and advantage of the present invention is to provide a new tabletop arrangement that is interchangeable and capable of being attached to or mounted on any standard existing drafting table base. The tabletop includes a rotatable circular element with a locking pin for securing in place the circular element. The locking pin is capable of being disengaged from the circular element by pulling a lever on a front side edge of the table so that the lever retracts the locking pin engageable in the circular element. The pin is selectively placed in one of the other 360 holes spaced 1° apart located around an edge of the circular element. Releasing the lever causes a spring to drive the pin into a desired hole corresponding to a given degree or orientation of the circular element with respect to the tabletop. According to the invention, the lever consists of a sprig loaded eyebolt with a wooden knob on the outer end. The lever is reciprocally mounted on the table and a linkage member connects the lever to the locking pin which is situated to enter one of the sockets or apertures in the circular element for selected locking thereof. The locking pin may be constructed from an eyebolt which is placed through a bracket and having a spring retained by a nut or stop placed on the bolt so that the spring maintains engagement with the circular element until retracted by pulling on the lever.

Another and further object and advantage of the present invention is to provide a tabletop and circular element construction having concaveconvex interfacing members for stabilizing the circular element with respect to the tabletop and also to provide improved accuracy, orientation and improved use of the drawing, tracing and light table. Thus, it is seen that the method and arrangement of locking the circular element centrally of the tabletop is expedient to both a draftsman and in the details of its manufacture, involving fewer moving parts and is less expensive to manufacture. The tabletop construction provides easier access to the work by the draftsman thereby resulting in a higher degree of accuracy of the drawings. The concave-convex edges interfacing circular element and the tabletop provide more free moving capability through the use of the lazy susan swival member and by means of the lever arrangement, the released locking spring pin provides for selective rotational displacement of the circular element. Only one lever is retracted to permit rotational movement of the circular element within the tabletop so that the table can be used not with a T-square but also with parallel arms and drafting equipment.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
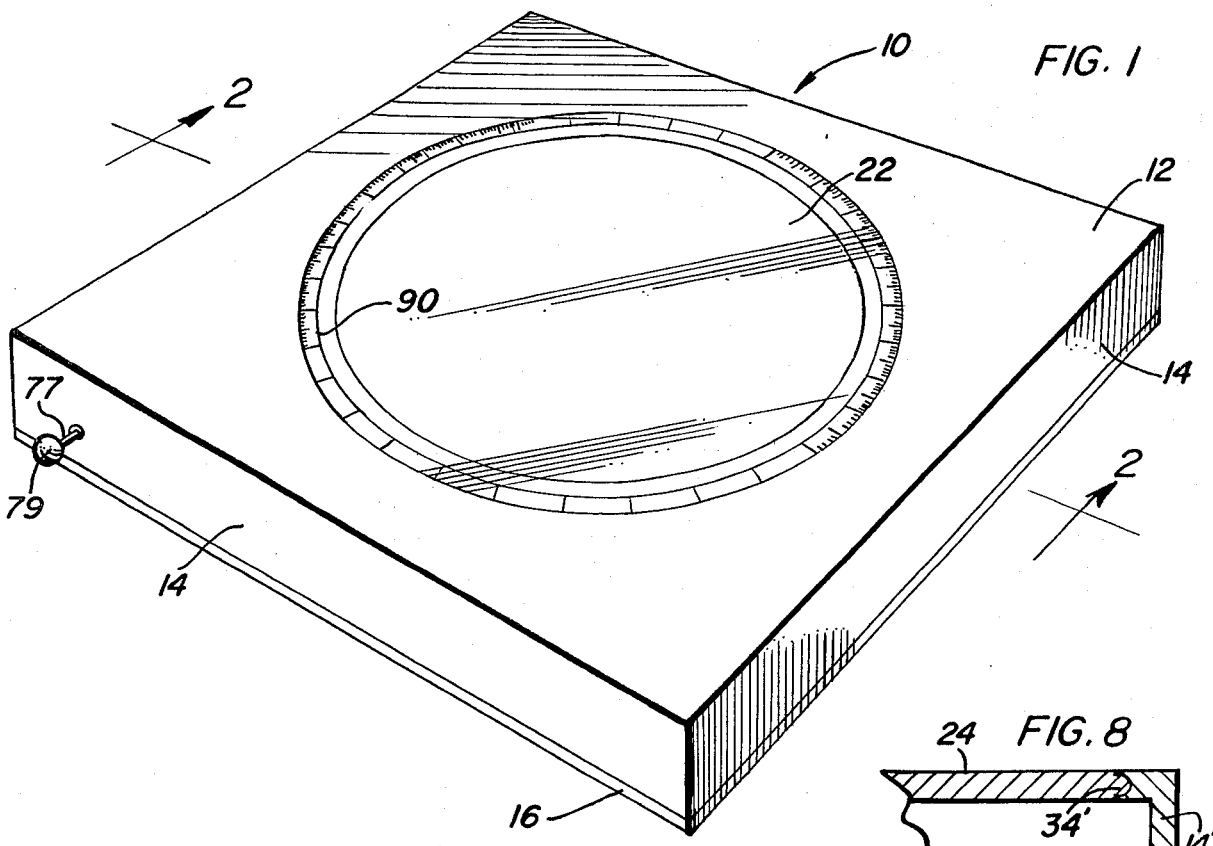
FIG. 1 is a front perspective view of the circular tracing and light table of the present invention.

Referring now to FIGS. 1–7 of the drawings, there is shown a circular tracing and light table 10 having a tabletop 12 of a rectangular or generally square configuration and including integrally therewith a set of four sidewalls 14 supported by a base plate 16 extending entirely throughout as an undercover or base for the table 10. The base plate 16 is provided with resilient and non-skid supporting feet 18 of rubber or other elastomeric materials for spacing the base plate 16 above a table surface or work surface 20. The tabletop is constructed of wood, metal, plastic or similar rigid materials and centrally disposed within an opening in the tabletop 12 is a circular disc 22 constructed of translucent or transparent material such as glass as is well known in the art as shown in FIGS. 1–5.

Within the tracing and light table 10 below the circular disc 22, there is at least a pair of fluorescent lights or lamps 26 supportably mounted from end supports 28 affixed to a base support 30 in mounting relation as shown. The support 30 is a circular base having a cylindrical side 32 terminating at its upper edge in a circular frame 33 having an annular bead 34 extending around the outer periphery and terminating along an inner periphery in an annular flange 36 constructed of sufficient strength, thickness and material to support the circular disc 22 so that the top surface of the circular discs 22 is coplanar throughout with the top or outer surface of the tabletop 12.

The assembly of the support 30 with the annular frame 33 can be of several component parts and the tabletop 12 can be constructed of several component parts to aid in the assembly of the disc 22 into working relation with the tabletop 12.

The support 30 is supported by a central swivel assembly 50 such as that used in a conventional lazy susan provided with ball bearings 52. The central swivel assembly 50 is supported by a base plate 54 mounted or affixed to the central area of the support 16. An electrical supply assembly can be constructed to pass through the central swivel assembly 50 including electrical supply conductor 58 and conductors 60 which connect with the fluorescent light assemblies in a conventional manner with the swivel assembly including a conventional rotary electrical connection (not shown).

The convex surface of the annular bead 34 is provided throughout its entire peripheral surface with a series of pin receiving holes or sockets 64 spaced exactly 1° apart (shown in FIG. 3) and oriented radially from a center of the circular disc 22. It is, of course, realized that the interface between the annular bead 34 and surface 13 may be cylindrical in cross section, a truncated conic surface or dihedrally truncated conic surfaces terminating in a ridge structure or the like, but a preferred arrangement is that the circular disc has a convex, peripheral surface forming the annular bead 34 and engaging the inwardly facing concave surface 13 in the opening in the tabletop 12 thereby stabilizing the circular disc 22 during rotation.

Figure 3:
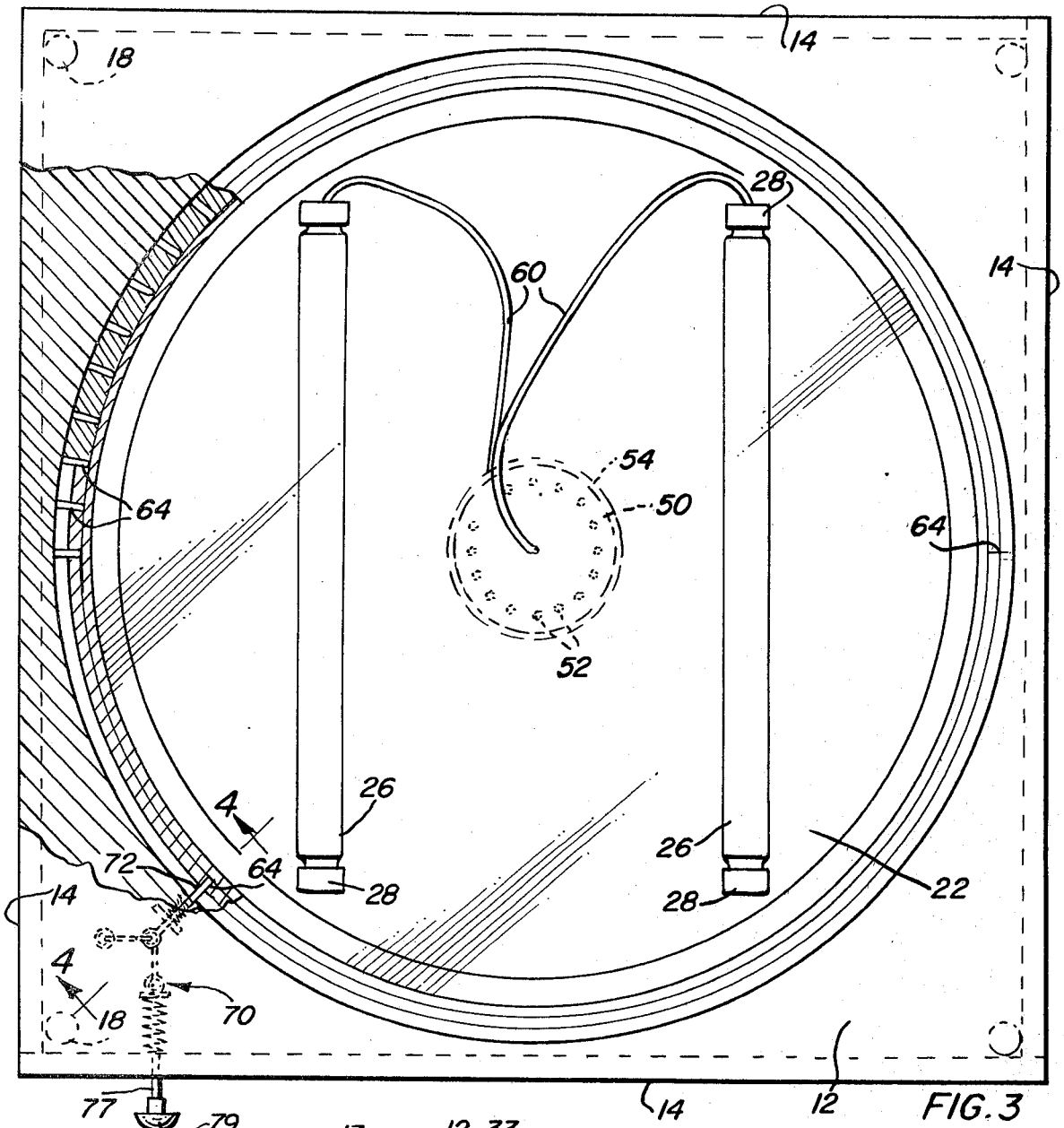
FIG. 3 is a sectional view taken along lines 3—3 of FIG. 2.
Figure 4:
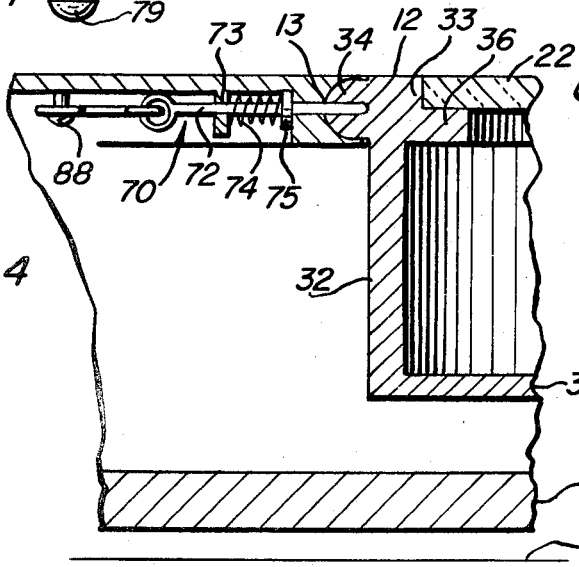
FIG. 4 is an enlarged sectional view taken alnog lines 4—4 of FIG. 3.
Figure 5:
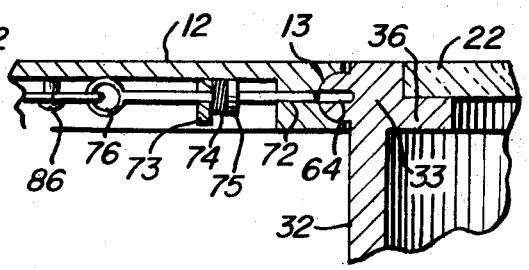
FIG. 5 is a similar view to that of FIG. 4 but having the pin shown in its retracted position.

A locking assembly 70 (FIGS. 3–7) includes a pin 72 received within one of the pin receiving holes 64 to lock the disc 22 in desired position as shown in FIGS. 3 and 4, but by operation of the locking assembly 70, the pin 72 is withdrawn from the hole 64 as shown in FIG. 5.

Figure 6:
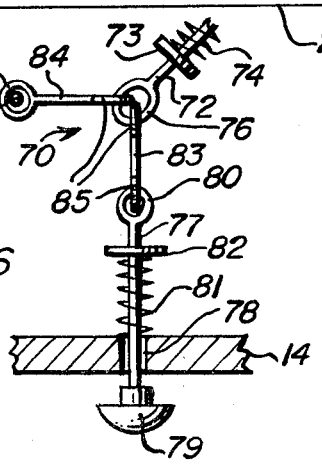
FIGS. 6 and 7 show plan views of details of the actuating mechanism for the locking spring pin.
Figure 7:
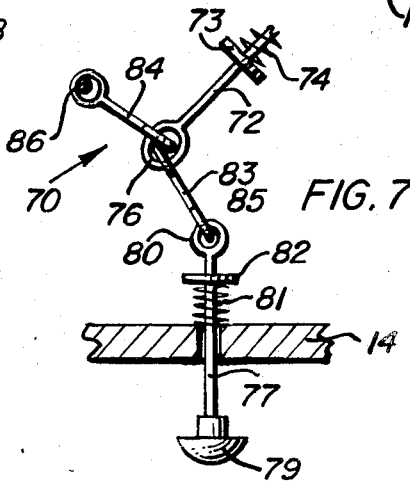

The pin 72 slides through an apertured depending bracket 73 on the undersurface of tabletop 12 and a spring 74 surrounds the pin 72 and is positioned between the bracket 73 and a stop 75 fixed to the pin 72 inwardly from the inner end thereof to spring bias the pin 72 towards its locking position. The outer end of pin 72 includes an eye member 76 by which the pin 72 can be retracted. An actuating rod 77 slides through an aperture 78 in wall 14 and has a knob 79 on the outer end and an eye 80 on the inner end. A coil spring 81 encircles the rod and has one end abutting the inner surface of wall 14 and the other end abutting a stop 82 on rod 77 to bias the rod inwardly. A pair of short rods 83, 84 having an eye 85 on each end thereof are connected to eye 76 on rod 72 with rod 83 being connected to rod 77 and rod 84 being anchored to a fastening bolt 86. The locking position of the components is shown in FIGS. 4 and 6 in which rods 83 and 84 are perpendicular and the unlocked position is shown in FIGS. 5 and 7 in which outward movement of rod 77 moves the rods 83 and 84 toward a straight line position thus retracting the pin 72.

A short flexible cable (not shown) may replace the rods 83, 84 and operate in the same manner with the central portion of the cable extending through the eye 76 and the ends of the cable attached to eye 80 and anchor 86.

Each of the circular discs 22, 24 has indicia indicating 360° which correspond with the 360 holes or sockets 64 with the 360° indicia being arranged in four quadrants of 90° each and the discs can be constructed of a diameter to accommodate any size paper with rotation of the disc enabling the area of the paper being worked on to be moved closer to the user.

Figure 8:
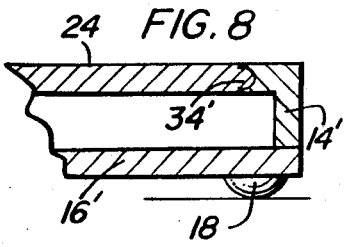
FIG. 8 is a fragmental sectional view of a drawing or drafting table similar to FIGS. 1-7 in which the circular table element is opaque and illumination arrangements are omitted.
Figure 2:
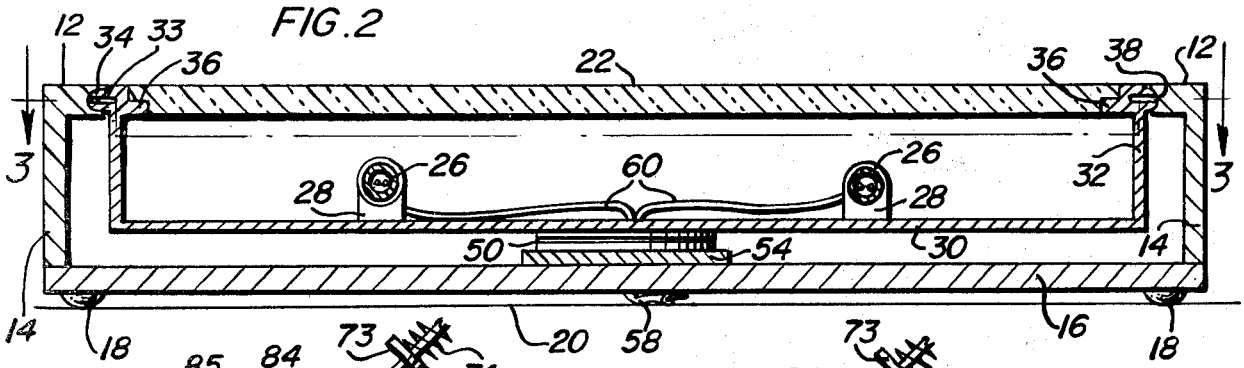
FIG. 2 is an enlarged sectional view taken along lines 2—2 of FIG. 1.

FIG. 8 illustrates the structure of the drafting and drawing table 10' having structural features similar to table 10 except that the disc 24 is opaque and is of one-piece construction with the disc being supported directly from the bottom or base 16' by a swivel assembly similar to swivel assembly 50 except that no electrical supply arrangment is provided since the illumination arrangement is eliminated. Also, absence of the lights enables the vertical height of the walls 14' to be shortened and the bead 34' is unitary with the disc 24.

The square tabletop 12 enables a T-square, parallel bar, drafting machine or other drafting instruments to be used in a conventional manner. Also, the drafting and drawing and the tracing and light tabletops may be interchangeably mounted to any standard existing drafting table base.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A drafting table assembly comprising a tabletop having a generally planar work surface and having an enlarged circular opening therein, a flat circular disc disposed in said opening in coplanar relation to the tabletop, the circular disc and the tabletop having convex-concave interfacing elements therebetween, a retractable pin within the tabletop for engaging with one of a series of equally spaced pin receiving holes disposed along the interfacing element of the circular disc, an actuating rod extending from one edge of the tabletop for controlling engagement of the pin with said holes, the actuating rod being disposed at an angle to the pin on one side of a plane containing the longitudinal axis of the pin, first linkage means connected between an inner end of the rod and an outer end of the pin, an anchoring means disposed in the tabletop on the opposite side of said plane, and second linkage means connected between the anchoring means and the outer end of the pin, the first and second linkage means effecting withdrawal of the pin from one of said holes responsive to outward movement of the actuating rod in relation to said edge of the tabletop.

2. The invention according to claim 1 wherein spring means biases the retractable pin into engagement with the hole in the circular disc, and in which there are at least 360 holes equally spaced about the interface of the circular disc.

3. The invention according to claim 1 wherein the circular disc is constructed of opaque material.

4. The invention according to claim 1 wherein the circular disc is constructed of transparent material and a set of at least two fluorescent lamps are supportedly mounted beneath the transparent material of the circular disc for illuminating an upper work surface thereof.

5. The invention according to claim 1 wherein the retractable pin comprises an eyebolt mounted from a bracket in the tabletop, with the eye of the eyebolt defining said outer end of the pin, and the first and second linkage means comprise further eyebolt elements connected between said eye, the inner end of the actuating rod, and the anchoring means.

6. The invention according to claim 1 wherein the table assembly is supportedly mounted from a base plate having sidewalls, and lazy susan swivel means being disposed centrally therein for support of a base portion of the circular disc.

7. The invention according to claim 1 wherein the first and second linkage means define an angle therebetween when the pin is in engagement with one of said holes, and the linkage means move towards a straight-line orientation when the pin is withdrawn from the hole by outward movement of the actuating rod.

8. The invention of claim 1 including first spring means biasing the pin toward engagement in one of said holes and second spring means biasing the actuating rod inwardly with respect to said edge of the tabletop.

* * * * *